US005126015A

United States Patent [19]

Pounder

[11] Patent Number: 5,126,015

[45] Date of Patent: Jun. 30, 1992

[54] METHOD FOR SIMULTANEOUSLY DRYING AND IMPRINTING MOIST FIBROUS WEBS

[75] Inventor: Joseph R. Pounder, Appleton, Wis.

[73] Assignee: James River Corporation of Virginia, Richmond, Va.

[21] Appl. No.: 626,284

[22] Filed: Dec. 12, 1990

[51] Int. Cl.[5] ..... D21F 11/00; D21H 27/02

[52] U.S. Cl. ..... 162/206; 162/116; 162/117; 162/362

[58] Field of Search ..... 162/206, 207, 113, 116, 162/117, 361, 362; 34/152, 113; 156/209, 199

[56] References Cited

U.S. PATENT DOCUMENTS

| | | | |
|---|---|---|---|
| 3,301,746 | 1/1967 | Sanford et al. | 162/206 |
| 3,806,406 | 4/1974 | Ely | 162/206 |
| 4,076,867 | 2/1978 | Lewicki, Jr. et al. | 156/209 |
| 4,102,737 | 7/1978 | Morton | 162/207 |
| 4,196,045 | 4/1980 | Ogden | 162/206 |

FOREIGN PATENT DOCUMENTS

| | | | |
|---|---|---|---|
| 0033988 | 8/1981 | European Pat. Off. | 162/206 |
| 8503962 | 9/1985 | PCT Int'l Appl. | 162/362 |

*Primary Examiner*—Karen M. Hastings
*Attorney, Agent, or Firm*—Finnegan, Henderson, Farabow, Garrett and Dunner

[57] ABSTRACT

A method for simultaneously drying a moist fibrous web and imprinting a pattern in each side thereof by passing the web through the nip between a patterned heated roll and a pressing roll, on a carrier having a nonplanar imprinting surface.

16 Claims, No Drawings

METHOD FOR SIMULTANEOUSLY DRYING AND IMPRINTING MOIST FIBROUS WEBS

BACKGROUND OF THE INVENTION

The present invention relates to the drying of moist fibrous webs. More particularly, the present invention relates to simultaneously drying and pattern imprinting both sides of moist fibrous webs in the production of sanitary tissue, paper towels, etc.

Moist paper webs are commonly dried by being pressed against the surface of a heated roll. This can be accomplished by passing the moist web through the nip between a pressing roll and the heated roll, with the rolls being compressed together under a sufficient load to provide good thermal contact between the web and the surface of the heated roll. However, since moist webs typically lack sufficient structural integrity to support themselves, they are usually overlaid on a carrier fabric for support. Accordingly, both the carrier fabric and the web are normally drawn through the nip between the pressing and heated rolls. In addition to providing support, the carrier fabric also provides a permeable surface allowing for the absorption and escape of any liquid or vapor as the web passes through the nip.

A common apparatus for drying paper webs in this manner is the so-called Yankee Dryer. In the Yankee Dryer, the web is firmly pressed against a steam heated cylinder by a pressing roll.

In addition, other, more efficient heated-roll web-drying apparatuses are disclosed in U.S. Pat. No. 4,324,613. In these apparatuses, the external surface of the heated roll is heated directly by an externally mounted heat source such as, for example, gas burners positioned near the roll surface. By heating the external surface of the roll in this manner, the surface of the heated roll can be heated to a temperature sufficient to cause a very rapid and violent generation of steam at the interface between the roll and the moist web during the pressing step. The steam thus formed tends to pass straight through the web, carrying with it any free water remaining in the cavities between the fibers of the web. Accordingly, the rapid generation of steam greatly enhances the drying effect of the apparatus by physically removing liquid water from the web.

In addition to modifications of such heated-roll drying apparatuses aimed at increasing the drying efficiency thereof, modifications of the carrier fabric have been proposed as a means for increasing the softness, bulk and absorbency of the dried web. For example, in European Patent Application No. 109307, published Jun. 23, 1984, a carrier felt is disclosed having yarn strands which form knuckles adjacent to and protruding above the web contacting side of the felt. Consequently, as the paper web and carrier felt pass through the nip, the knuckles densify those portions of the web between the knuckles of the felt and the dryer surface to a greater degree than those portions of the web that are being pressed against the surface of the dryer by the felt facing located between adjacent imprinting yarn strands. Reportedly, by using such a felt, the less dense portions of the web produced tend, on average, to be thicker than the thickness of a web produced by using a comparable smooth-surfaced felt, which accounts for the increased softness, bulk and absorbency characteristics of the resulting web.

However, such a method of imprinting a pattern into the surface of a web is less than optimal since it is only capable of imprinting a pattern into one surface of the web, and results in a web having one smooth planar surface and one nonplanar patterned surface. Moreover, such a method for imprinting a pattern into only one surface of the web is inadequate to prevent the destruction, during the drying operation, of patterns of raised and recessed areas created in both surfaces of the moist web during web formation.

Accordingly, it is an object of the present invention to provide an efficient method for imprinting a pattern on both sides of a web while contemporaneously drying the web by contact with the surface of a heated roll. Additionally, it is also an object of the invention to provide an efficient method for drying a web without damaging patterns of raised and recessed areas created in the surfaces of the moist web during web formation.

The foregoing objectives have been satisfied by the method of the invention described in detail below.

SUMMARY OF THE INVENTION

The present invention provides a method for simultaneously drying a moist fibrous web and imprinting a pattern into each side thereof. This method comprises the steps of: (a) depositing the moist fibrous web onto a porous carrier, the surface of the carrier adjacent to the web being nonplanar and composed of raised and recessed areas which define a first pattern to be imprinted into the side of the web adjacent thereto; and (b) passing the web and carrier through the nip between a pair of rotatable rolls, the surface of the roll contacting the web being heated to a temperature high enough to cause drying of the web and the surface having a second pattern of raised and recessed areas to be imprinted into the side of the web adjacent thereto, the rolls being pressed together under a sufficient load to produce thermal contact between the surface of the heated roll and the web and to cause the respective first and second patterns to be imprinted into opposite sides of the web.

Pattern imprinting both sides of such webs in this manner not only provides a more aesthetically pleasing product, but, in addition, provides greater control over the bulk, softness and absorbency of the resulting product. Additionally, pattern imprinting both sides provides greater flexibility and control over the properties of such webs affecting further processing steps such as the creping of the webs off the surface of the heated roll.

The present invention also provides a method for drying a web having patterns of raised and recessed areas already formed in one or more of the surfaces thereof without damaging the patterns. The creation of such patterns in the surfaces of moist fibrous webs during the web-forming operation is disclosed in U.S. patent application Ser. No. 07/428,823. Creating such patterns in the web surfaces during the web-forming operation advantageously provides a more efficient utilization of fibers in forming the resultant product than is obtained by forming a web of uniform thickness, comprising a substantially uniform distribution of fibers, and imprinting patterns into it with heat and pressure. By placing the fibers where they are needed to create the patterned surfaces in the web-forming operation, rather than attempting to press the fibers into the desired configuration after web formation, fibrous products having a greater bulk or thickness per weight of fibers may be produced.

However, in order to take advantage of the more efficient fiber utilization afforded by creating such patterns in the web surfaces during the web-forming operation, the moist webs must be dried without damaging the patterns created therein. Unlike conventional drying operations which typically flatten such patterns formed in the wet web, the process of the invention provides a method for drying such webs without undesirably flattening the patterns formed in the surfaces.

Drying such wet patterned webs without removing the patterns formed in the web surfaces is accomplished by the method of the invention by providing the surface of the heated roll and/or the surface of the carrier with a pattern of raised and recessed areas which mates with the pattern formed in the surface of the wet web adjacent thereto, and passing the wet web and carrier through the nip between the heated roll and pressing roll such that the patterns on the surface of the heated roll and/or the carrier are in register with the patterns formed in the surfaces of the web adjacent thereto. By drying the web in this manner, the patterns of raised and recessed areas formed in the surfaces of the wet web are dried and set into the resulting web.

DETAILED DESCRIPTION OF THE PREFERRED EMBODIMENTS

The present invention provides a method for both drying a moist fibrous web and for simultaneously imprinting a pattern into both sides of the web in a one-step operation. Additionally, the present invention provides a method for drying a moist fibrous web having patterns of raised and recessed areas formed in its surfaces without damaging the patterns. Although this process is hereinafter described with respect to the manufacture of fibrous paper products, the method of the invention is not limited thereto and is equally applicable to the simultaneous patterning and drying of other types of moist webs.

According to a preferred embodiment of the invention, a moist fibrous web is first deposited onto a porous carrier having a nonplanar surface composed of raised and recessed areas which define a pattern, such that the web is in contact with the nonplanar surface of the carrier. The carrier and web are then passed through the nip between a pressing roll and a roll having a second pattern of raised and recessed areas on its surface, and its surface heated to a temperature sufficient to effectuate drying of the web. The carrier and web are passed through the nip in such manner that the web is pressed firmly against the surface of the heated roll by the pressing roll. Under the load generated by the pressing roll, the pattern of raised and recessed areas of the nonplanar surface of the carrier is imprinted into one side of the web and the pattern of raised and recessed areas of the surface of the heated roll is imprinted into the opposite side of the web, as the web is pressed against the surface of the heated roll and dried.

Porous carriers useful in the present invention are typically woven fabrics. The nonplanar surface of such carrier fabrics can be formed by suitable selection of yarn diameters, yarn spacing and weaving patterns. Such carrier fabrics are commercially available from several suppliers.

The moisture content of fibrous webs to be dried and patterned by this method can vary widely depending upon such factors as the thickness of the web, the moisture content desired in the dry patterned web, the surface temperature of the heated roll and the contact time between the web and the heated roll. Generally, it is preferred that the moisture content of the wet fibrous web be less than about 65 percent by weight.

The surface temperature of the heated roll may be any temperature sufficient to cause drying of the web and may vary over a wide range of temperatures depending upon such factors as the moisture content of the web to be dried, the thickness of the web, the contact time between the web and the heated roll and the moisture content desired in the dry patterned web.. Preferably, the surface temperature of the heated roll is sufficient to cause a rapid, violent generation of steam at the interface of the roll and web, so as to take advantage of the increased drying efficiency resulting from the tendency of such steam to carry liquid water away from the web. However, of course, the surface temperature must be kept below that which will cause thermal degradation of the web material. Accordingly, a surface temperature of the heated roll ranging from about 300° F. to 600° F. is preferred for drying and patterning wet fibrous paper webs.

In a second embodiment, the method of the invention may be used to dry a web already having patterns of raised and recessed areas formed into one or both of its surfaces without damaging said patterns. For example, when the method of the invention is being used to dry a web already having such patterns formed into both of its surfaces, the pattern of raised and recessed areas on the surface of the carrier should mate with the pattern formed in the side of the web adjacent to the carrier, and the pattern of raised and recessed areas on the surface of the heated roll should mate with the pattern formed in the side of the web adjacent to the heated roll. Moreover, the web should be passed through the nip between the heated roll and the pressing roll such that the patterns formed in its surfaces are in register with the patterns on the surfaces of the heated roll and the carrier, respectively.

Of course, when the method of the invention is being used to dry a web having a pattern of raised and recessed areas formed in only one surface thereof, and it is desired that the dry web have only the one patterned surface, only the surface of the carrier or heated roll adjacent to the patterned surface of the web should have a pattern which mates with the pattern on the surface of the web. The surface of the other, which is adjacent to the nonpatterned surface of the web, should be smooth.

Moreover, if the wet web has only one patterned surface and it is desired that both surfaces of the dry web have patterns formed therein, the surface of the carrier or heated roll adjacent the patterned surface of the web should have a pattern on its surface which mates with the pattern on the web surface, and the surface of the other, which is adjacent to the nonpatterned web surface, may have a pattern of raised and recessed areas to be imprinted into the nonpatterned surface of the wet web.

The patterns on the surface of the heated roll and the carrier may be the same or different. For example, the pattern on the surface of the carrier may comprise a series of parallel raised portions which span the width of the carrier and are separated by recessed portions, and the pattern on the surface of the heated roll may comprise a series of parallel raised portions encircling the heated roll separated by recessed portions. The raised portions of the surface of the carrier thus produce indentations in the web surface adjacent thereto, as the web passes through the nip, which are perpendicular to the indentations generated in the opposite surface of the web by the raised portions of the surface of the heated roll (i.e., the raised portions of the heated roll impart a series of parallel indentations in one surface of the web in the machine direction and the raised portions of the carrier impart a series of parallel indentations in the opposite surface of the web in the cross-machine direction).

Thus, the drying operation simultaneously creates three types of density zones within the dry web: (1) high density zones where the fibers of the dry web have a high adhesion to one another, which correspond to the intersections of the indentations in the machine direction of the web and the indentations in the cross-machine direction of the web; (2) intermediate density zones where the fibers of the dry web have an intermediate adhesion for one another, which correspond to the indentations formed in the web in both the machine direction and the cross-machine direction other than at the intersections thereof; and (3) low density zones where the fibers of the dry web have a low adhesion to one another, which correspond to the portions of the web not coextensive with the indentations formed in the web.

In contrast, when the patterns on the surfaces of the heated roll and the carrier are the same, the number of density zones generated in the resulting sheet depends upon the extent to which the pattern imprinted into the web by the heated roll coincides with the pattern imprinted into the web by the carrier. If there is no coincidence between the patterns formed in the web by the heated roll and carrier (i.e., the indentations formed in one side of the web do not overlap or coincide with the indentations formed in the opposite side of the web) the resulting sheet will have only two types of density zones. Medium density zones will exist in the areas of the web corresponding to the indentations and low density zones will exist in the remainder of the web.

Similarly, if there is exact coincidence between the patterns formed in the web by the heated roll and carrier (i.e., the indentations formed in one side of the web completely overlap or coincide with the indentations formed in the opposite side of the web) the resulting sheet will have only two types of density zones. High density zones will exist in the areas of the web corresponding to the indentations and low density zones will exist in the remainder of the web.

In contrast, if the patterns formed in the web by the heated roll and carrier only coincide in part (i.e., the indentations formed in one side of the web only partially overlap or coincide with the indentations formed in the opposite side of the web) the resulting sheet will have three types of density zones. High density zones will exist in the areas of the web where the indentations formed in the web by the heated roll overlap with the indentations formed in the web by the carrier, intermediate density zones will exist in the areas of the web corresponding to the nonoverlapping portions of the indentations and low density zones will exist in the remainder of the web.

The foregoing discussion has assumed that the depth of the indentations formed in the web by the patterns on the surfaces of the heated roll and the carrier are uniformly the same. However, if the depth of the indentations formed in the web by the heated roll is not the same as the depth of the indentations formed in the web by the carrier, the resulting web may have zones of different intermediate and high densities. Similarly, if the depth of the indentations formed by the heated roll or the carrier are not uniform, the resulting web may have zones of different intermediate and high densities.

The presence of these density zones provides great control over the properties of the resulting web. For example, by regulating the occurrence, and the absolute and relative sizes of these zones, the strength and softness of the resulting dry web can be easily controlled and varied over a wide range.

The foregoing examples are for purposes of illustration only, and in no way limit the scope of the present invention.

What is claimed is:

1. A method for simultaneously drying a moist fibrous web and imprinting a pattern in each side thereof, which comprises the steps of:

(a) depositing said moist fibrous web on a porous carrier, the surface of said carrier adjacent to said web being nonplanar and composed of raised and recessed areas which define a first pattern to be imprinted into the side of the web adjacent thereto; and (b) passing said web and carrier through the nip between a pair of rotatable rolls, wherein the surface of the roll contacting said web is heated to a temperature high enough to cause drying of the web and has a second pattern of raised and recessed areas to be imprinted into the side of said web adjacent thereto, said rolls being pressed together under a sufficient load to produce thermal contact between the surface of said heated roll and said web and to cause the respective first and second patterns to be imprinted into opposite sides of said web.

2. A method for simultaneously drying a moist fibrous web and imprinting a pattern in each side thereof as recited in claim 1, wherein said porous carrier comprises a woven fabric.

3. A method for simultaneously drying a moist fibrous web and imprinting a pattern in each side thereof as recited in claim 2, wherein said porous carrier comprises felt.

4. A method for simultaneously drying a moist fibrous web and imprinting a pattern in each side thereof as recited in claim 1, wherein the surface of said heated roll is heated to a temperature sufficient to cause the moisture in said web to be converted rapidly and violently into steam at the interface of said web and said heated roll.

5. A method for simultaneously drying a moist fibrous web and imprinting a pattern in each side thereof as recited in claim 4, wherein the surface temperature of said heated roll is in the range of from about 300° F. to 600° F.

6. A method for simultaneously, drying a moist fibrous web and imprinting a pattern in each side thereof as recited in claim 5, wherein the moisture content of said web is less than about 65 percent by weight prior to drying.

7. A method for simultaneously drying a moist fibrous web having a moisture content less than about 65 percent by weight and imprinting a pattern in each side thereof, which comprises the steps of:

(a) depositing said moist fibrous web having a moisture content less than 65 percent by weight on a carrier felt, the surface of said carrier felt adjacent to said web being nonplanar and composed of raised and recessed areas which define a first pattern to be imprinted into the side of the web adjacent thereto; and (b) passing said web and carrier felt through the nip between a pair of rotatable rolls, wherein the surface of the roll contacting said web is heated to a temperature within the range of from about 300° F. to 600° F. and has a second pattern of raised and recessed areas to be imprinted into the side of said web adjacent thereto, said rolls being pressed together under a sufficient load to produce thermal contact between the surface of said heated roll and said web and to cause the respective first and second patterns to be imprinted into opposite sides of said web.

8. A method for drying a moist fibrous web having a pattern of raised and recessed areas formed into at least one surface thereof, which comprises the steps of:

(a) depositing said moist fibrous web on a porous carrier such that a patterned surface of said web is opposite the surface of said web in contact with said carrier; and (b) passing said web and carrier through the nip between a pair of rotatable rolls, wherein the surface of the roll contacting said web is heated to a temperature high enough to cause drying of the web and has a pattern of raised and recessed areas which mates with the pattern in the surface of said web adjacent thereto, said rolls being pressed together under a sufficient load to produce thermal contact between the surface of said heated roll and said web and said web being passed through the nip such that the pattern in the surface of said web is in register with the pattern on the surface of the heated roll.

9. A method for drying a moist fibrous web as recited in claim 8, wherein the surface temperature of said heated roll is in the range of from about 300° F. to 600° F.

10. A method for drying a moist fibrous web as recited in claim 9, wherein the moisture content of said web is less than about 65 percent by weight prior to drying.

11. A method for drying a moist fibrous web having a pattern of raised and recessed areas formed into at least one surface thereof without damaging said pattern, which comprises the steps of:

(a) depositing said moist fibrous web on a porous carrier, the surface of said carrier in contact with said web having a pattern of raised and recessed areas which mates with the pattern in a surface of said web, such that a patterned surface of said web is in contact with said carrier and the pattern in the surface of said web is in register with the pattern on the surface of the carrier; and (b) passing said web and carrier through the nip between a pair of rotatable rolls, wherein the surface of the roll contacting said web is heated to a temperature high enough to cause drying of the web, said rolls being pressed together under a sufficient load to produce thermal contact between the surface of said heated roll and said web.

12. A method for drying a moist fibrous web as recited in claim 11, wherein the surface temperature of said heated roll is in the range of from about 300° F. to 600° F.

13. A method for drying a moist fibrous web as recited in claim 12, wherein the moisture content of said web is less than about 65 percent by weight prior to drying.

14. A method for drying a moist fibrous web having patterns of raised and recessed areas formed into opposite surfaces thereof, which comprises the steps of:

(a) depositing said moist fibrous web on a porous carrier, the surface of said carrier in contact with said web having a pattern of raised and recessed areas which mates with the pattern in the surface of the web adjacent thereto; and (b) passing said web and carrier through the nip between a pair of rotatable rolls, wherein the surface of the roll contacting said web is heated to a temperature high enough to cause drying of the web and has a pattern of raised and recessed areas which mates with the pattern in the surface of the web adjacent thereto, said rolls being pressed together under a sufficient load to produce thermal contact between the surface of said heated roll and said web, and said web being passed through the nip such that the pattern in one surface of said web is in register with the pattern on the surface of the carrier and the pattern in the opposite surface of the web is in register with the pattern on the surface of the heated roll.

15. A method for drying a moist fibrous web as recited in claim 14, wherein the surface temperature of said heated roll is in the range of from about 300° F. to 600° F.

16. A method for drying a moist fibrous web as recited in claim 15, wherein the moisture content of said web is less than about 65 percent by weight prior to drying.

* * * * *